United States Patent [19]

Hornung et al.

[11] 4,003,208

[45] Jan. 18, 1977

[54] ASSEMBLY FOR PREVENTING THE FALL OF DUST AND DEBRIS IN A MINE

[76] Inventors: Gerd Hornung, Opmunder Weg 14; Franz Disse, Deventerweg, both of 477 Soest; Peter Rössler, Lippestrasse 49, 470 Hamm, all of Germany

[22] Filed: Sept. 2, 1975

[21] Appl. No.: 609,614

[30] Foreign Application Priority Data

Sept. 3, 1974 Germany ..... 2442177

[52] U.S. Cl. ..... 61/45 D; 29/191; 29/191.4

[51] Int. Cl.[2] ..... L21D 19/00

[58] Field of Search ..... 61/45 C, 45 R, 45 D, 61/63; 29/191, 191.4; 428/256

[56] References Cited

UNITED STATES PATENTS

| | | | |
|---|---|---|---|
| 2,099,047 | 11/1937 | Bradshaw | 428/256 |
| 2,361,620 | 10/1944 | Gerlach et al. | 29/191 |
| 2,371,789 | 3/1945 | Batten | 61/45 C |
| 2,728,698 | 12/1955 | Rudner | 428/256 |
| 3,107,902 | 10/1963 | Calder | 61/45 C |
| 3,902,324 | 9/1975 | Barrett | 61/45 C |

FOREIGN PATENTS OR APPLICATIONS

| | | | |
|---|---|---|---|
| 2,043,034 | 3/1972 | Germany | 29/191 |
| 2,015,464 | 11/1971 | Germany | 61/45 C |

*Primary Examiner*—Paul R. Gilliam
*Assistant Examiner*—Alex Grosz
*Attorney, Agent, or Firm*—Lowe, King, Price & Markva

[57] ABSTRACT

An assembly for preventing the falling of dust and debris from the roof and from the break of a mine, particularly a coal mine. The assembly comprises a shield support structure having roof bars and a roof covering disposed between the roof of the mine and the roof bars. The roof covering includes a welded wire-netting sheet having longitudinal and transverse wires with a dust-tight web welded or fixed in between said longitudinal and transverse wires.

9 Claims, 2 Drawing Figures

ASSEMBLY FOR PREVENTING THE FALL OF DUST AND DEBRIS IN A MINE

BACKGROUND OF THE INVENTION

This invention relates to an assembly which prevents the falling of fine dust from the roof and the break in a mining operation. The assembly includes the shield support and the step support and prevents existing stone dust and stone or rock from falling from the roof and the break.

The amount of stone dust around a shield support in the working region of a mining operation is relatively large. The prior art has provided a shield support and a step support which is used to prevent the roof of a mine from caving in. The shield or frame supports include roof bars or caps which are pressed under the roof with a great amount of pressure. The shields or frames are moved forwardly as the mining operation continues. The forward movement of the shield or frame causes an alternation of stress on the roof thereby forming a layer of loose stone above the roof bars. This is known in the prior art as the "trample effect". The loose stone layer is described as debris and comprises pieces of stone of varying size. The proporation of dust is relatively low in this debris.

It is further known to fit a roof covering between the roof and the roof bars of the shield or support frames to further prevent this debris from falling through the spaces between the roof bars into the working region therebelow. The prior art roof covering usually consists of a wire-netting sheets which extend from the forward points of the roof bars at the face over the roof bars into the break. The wire-netting sheets can be arranged both parallel to the face of the roof bars and also in the working direction which is transverse to the face. When the shield or frame supports are moved forwardly during the mining operation, the wire-netting sheet is unrolled from a roll held in readiness. Alternatively, a sheet may be fitted to another sheet so that the entire roof surface is covered with wire-netting. Any debris loosened above the wire-netting is held on the roof. Upon movement of the shield or frame supports as noted, the debris is carried off to the break at a point displaced from the working area.

The shield supports and the shields are closely adjacent one another. However, upon moving the shields or the supports, the debris may pass into the gaps between the shields even if wire of the conventional type is already drawn thereacross. That is, part of the debris may fall through the mesh of the wire-netting. When parts of the debris fall between the shields, the reciprocal movement of the shield grind the stone to dust therebetween. The dust is whirled up by the air current and thus passes into the respiratory systems of the miners.

Heretofore, the roof and coal face of the mine has been sprayed with relatively large amounts of water to hold the amount of dust down. This is a disadvantage because the water binds the existing dust particles which coagulate to a cement-like mass and restrict the freedom of movement of the shield roof bars. The cement-like mass particularly obstructs the triangular shaped space between the shield roof bar and the break shield. Consequently, the shield roof bar becomes almost incapable of movement.

It is known that the dust which arises when the debris occurs above the roof bars as a result of the trample effect is still relatively small. The greatest amount of dangerous dust is produced only when those shields and their supports are moved.

PURPOSE OF THE INVENTION

The primary object of the invention is to provide a dust-tight roof covering used in combination with a shield or step support and is stable, flexible and safely maintains dust-tightness during working in the shield or step support.

Another object of the invention is to provide an assembly comprising a dust-tight roof covering in combination with a shield or step support useful in coal mining.

SUMMARY OF THE INVENTION

The invention as described herein is directed to an assembly for preventing the falling of dust and debris from the roof and from the break of a mine. The assembly comprises a shield support structure having roof bars and a roof covering disposed between the roof of the mine and the roof bars. The roof cover covering includes a welded wire-netting sheet having longitudinal and transverse wires with a dust-tight foil or web welded in between the longitudinal and transverse wires.

Another feature of the invention is directed to the use of the web or foil in strips of predetermined width. These strips are welded in between the longitudinal and transverse wires and should match the distance of the spaces between the shields in the welded wire-netting sheet. These distances extend between the shield roof bars. The width of the strips of foil or web should be provided so that the dust-like stone matter is prevented from passing into the spaces between the shields.

Depending on whether the wire-netting sheet is used in a longitudinal transverse direction when drawn over the roof bars, the foil or foil strips may end at a predetermined distance from the edges of the wire-netting sheet. A strip-type covering of the wire-netting sheet with the dust-tight plastic foil or web further prevent the spread of any fire. The welded dust-tight foil or web may extend over the entire width of the wire-netting sheet from edge-to-edge.

A further feature of the invention is directed to the particular composition of the foil or web. The foil in a specific embodiment is composed of a plastic composition that is inherently elastic to preclude the foil fixed at the intersecting points of the wire-netting mesh from tearing if the net is distorted as a result of stress during the step process. More specifically, the foil or web may be composed of an inflammable polyethylene material. The combination of the contact between the intersection of the wires and the web or foil will immediately divert any electrostatic charges.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DESCRIPTION OF SPECIFIC EMBODIMENTS

Figure 1:
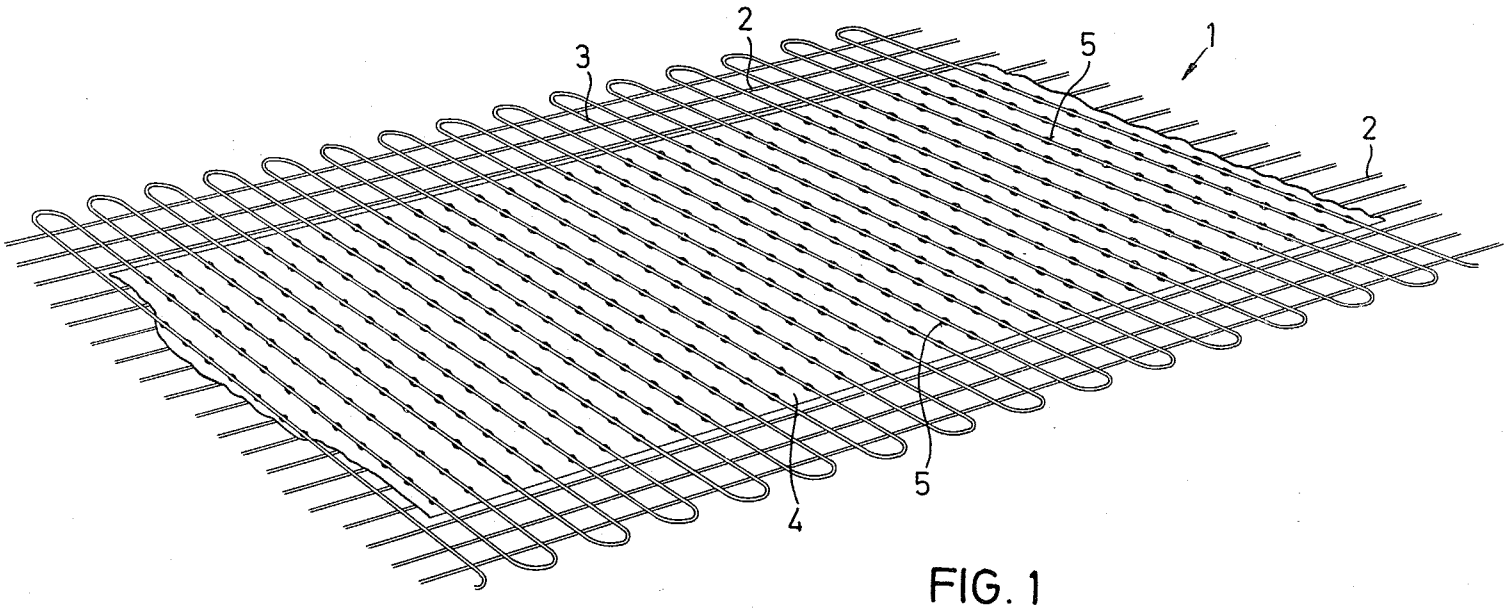
FIG. 1 is a perspective view of a roof covering made in accordance with this invention.

More specifically, referring to the drawings, the roof covering for the shield of step support comprises a wire net, generally designated 1, including a dust-tight web or foil 4 and longitudinal and transverse wires 2 and 3, respectively. The web 4 is composed of a plastic material and is welded in between the wires 2 and 3 which are at least 1mm in thickness. The longitudinal and transverse wires 2 and 3 wre welded directly to one another at their points of intersection 5. Web 4 is pressed through at the welded points and fixed through the wire-netting through the welding of the transverse and longitudinal wires 2 and 3 at each point of intersection. The mesh width of the wire-netting 1 is in a range of between 30 and 50mm. The meshes or netting may have a square, rectangular or rhomboid shape. Wires 2 and 3 are composed of iron and may have a thickness of between 1 and 2mm. In a specific embodiment, the wires 2 and 3 have a 1.6mm thickness used in the construction of the dust-tight roof covering.

Figure 2:
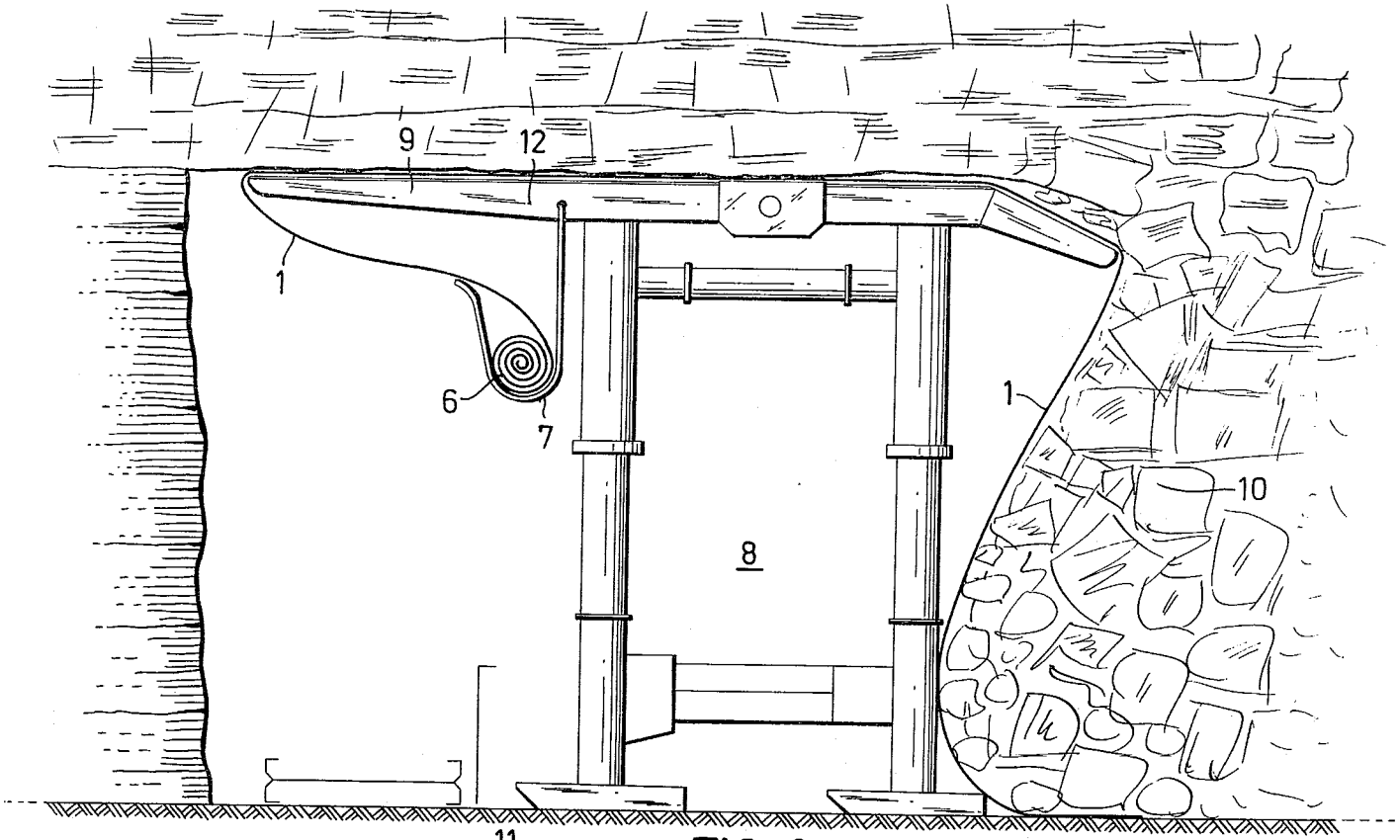
FIG. 2 is a side elevational view of a roof covering made in accordance with this invention shown disposed in a coal seam.

Referring to FIG. 2, the wire net or roof covering 1 is disposed in a roll 6 which is placed in a hanging device 7. A support frame structure 8, has a predetermined length of 20 to 30 meters and includes roof bars 9 below which the hanging device 7 extends. The roof covering or wire net 1 is unwound from the roll 6 and runs over the roof bars 9 to the break 10 in the work region of a mine as shown.

The supporting frame structure 8 is moved in the direction of the arrow 11 as the mining operation on the forward wall of the mine continues. During the advance of the support 8, the roof covering or net 1 is continuously drawn out of the roll 6. The dust-tight roof covering or wire net 1 prevents dust or pieces of stone or the like from falling downwardly onto the workmen. That is, rock loosened and falling from above does not penetrate through the structure 8. Stone and pieces of rock falling between the roof bars 9 is caught by the suspended roof covering or wire net 1.

The web 4 is extensively protected against external damage by the longitudinal and transverse wires 2 and 3 between which it is welded. That is, the web 4 is covered on both sides by the wires 2 and 3 of the wire-netting. The roof covering 1 prevents pieces of stone or coal which fall onto the roof covering from being able to perforate the wire-netting. The wires 2 and 3 absorb the impact of such pieces and cushion their impact with respect to the foil or web 4 of plastic material.

Web 4 is welded in at the point of intersection between the longitudinal wires 2 on one side and the transverse wires 3 on the other side. Consequently, web 4 is securely kept from slipping. When the roof covering 1 moves forwardly over the roof bars 9 or the spaces between adjacent shields or support frames, the wires lying underneath the roof covering 1 prevent damage to te dust-tight web 4 lying between the wires 2 and 3. The disposition of the foil or web 4 between the longitudinal and transverse wires 2 and 3 prevents the formation of small perforations through which dust-like stone particles can pass or trickle into the working regions below. The dust-like stone particles are held-back safely and reliably above the roof covering 1 with their bigger pieces or debris being carried off to the break 10 as the shields and their supports are moved forwardly.

The dust-tight roof covering 1 can either be unrolled from the rolls 6 or be drawn over the roof bars 9 by shifting a sheet in the direction of the coal face. By using the roof covering 1 of this invention, the danger of the lung penetrating stone dust for the minor working in the working region is considerably reduced. Furthermore, the functioning of the shield or frame support is no longer affected by stone particles or dust falling therethrough.

While the assembly for preventing the fall of dust and debris in a mine has been shown and described in detail, it is obvious that this invention is not to be considered as being limited to the exact form disclosed, and that changes in detail and construction may be made therein within the scope of the invention, without departing from the spirit thereof.

What is claimed is:

1. An assembly for preventing the falling of dust and debris from the roof and from the break of a mine, said assembly comprising:

a. a shield support structure having roof bars, b. a roof covering disposed between the roof of the mine and the roof bars, c. said roof covering including a welded wire-netting sheet having longitudinal and transverse wires with a dust-tight web welded in between and at points of intersection of said longitudinal and transverse wires, and d. said longitudinal wires being disposed on one side of the web and said transverse wires being disposed on the other side of the web.

2. An assembly as defined in claim 1 wherein the dust-tight web is composed of plurality of strips disposed within the wire netting sheet.

3. An assembly as defined in claim 1 wherein the dust-tight web extends from edge-to-edge of the wire-netting sheet.

4. An assembly as defined in claim 1 wherein the web is composed of a plastic composition that is inherently elastic and not easily flammable.

5. An assembly as defined in claim 1 wherein the web extends from edge-to-edge of the wire-netting sheet and is composed of a plastic composition that is inherently elastic and not easily flammable.

6. An assembly as defined in claim 1 wherein said web is composed of polyethylene.

7. In an assembly for preventing the falling of dust and debris from the roof of a mine, a roof covering disposed on a shield or step support, said roof covering comprising:

a. a wire-netting sheet having longitudinal and transverse wires of at least 1mm with a mesh width of about 30 to 50mm, b. a web of plastic material that is inherently elastic and not easily flammable and being fixed at the intersection points of and between the longitudinal and transverse wires, and c. said longitudinal wires being disposed on one side of the web and said transverse wires being disposed on the other side of the web.

8. A roof covering as defined in claim 7 wherein the thickness of the wires is 1.6 mm.

9. A roof covering as defined in claim 7 wherein said web is composed of polyethylene.

* * * * *